US005837063A

United States Patent [19]

Klug

[11] Patent Number: 5,837,063

[45] Date of Patent: Nov. 17, 1998

[54] OPERATOR AID FOR CLEANING RECESSED REFLECTIVE SENSORS IN DOCUMENT PROCESSING

[75] Inventor: Philip D. Klug, Westland, Mich.

[73] Assignee: Unisys Corp, Blue Bell, Pa.

[21] Appl. No.: 844,803

[22] Filed: Apr. 22, 1997

Related U.S. Application Data

[63] Continuation of Ser. No. 579,031, Dec. 18, 1995, abandoned.

[51] Int. Cl.[6] ..... B08B 1/00

[52] U.S. Cl. ..... 134/6; 15/106; 15/160; 134/18

[58] Field of Search ..... 15/106, 143.1, 15/159.1, 104.94, 160, 166, 210.1, 210.5, 244.1, 256.5; 134/6, 18

[56] References Cited

U.S. PATENT DOCUMENTS

| | | | |
|---|---|---|---|
| 169,906 | 11/1875 | Hunt | 15/166 |
| 857,239 | 6/1907 | Hawkins | 15/166 |
| 1,004,438 | 9/1911 | King | 15/166 |
| 1,291,770 | 1/1919 | Craig | 15/106 |
| 2,190,277 | 2/1940 | Viragh | 15/160 |
| 2,208,013 | 7/1940 | Baker | 15/106 |
| 2,677,840 | 5/1954 | Morton | 15/160 |
| 3,935,611 | 2/1976 | Locher | 15/160 |
| 4,208,755 | 6/1980 | Shepherd | 15/160 |
| 4,479,136 | 10/1984 | Lewis | 315/104.94 |
| 5,345,645 | 9/1994 | Page | 15/160 |

FOREIGN PATENT DOCUMENTS

| | | | |
|---|---|---|---|
| 673020 | 5/1966 | Belgium | 15/160 |
| 841973 | 2/1939 | France | 15/106 |
| 1578927 | 11/1980 | United Kingdom | 15/106 |

*Primary Examiner*—Randall Chin
*Attorney, Agent, or Firm*—John McCormack; Mark Starr

[57] ABSTRACT

A method of providing a track-cleaning wand for use in a document handling machine having a track along which documents are transported past sensors separated by a distance d and recessed away from the side walls of the track, this wand including a rigid handle with, at one end, a rigid elongate spacer bar carrying a pair of like brushes spaced apart by the sensor separation-distance and having bristles long enough to reach the face of a sensor, when the spacer bar is swept along the track.

8 Claims, 4 Drawing Sheets

OPERATOR AID FOR CLEANING RECESSED REFLECTIVE SENSORS IN DOCUMENT PROCESSING

This application is a continuation of patent application Ser. No. 08/579,031, filed Dec. 18, 1995, now abandoned.

FIELD OF INVENTION

This invention relates to the operation of document processing systems, focusing on maintenance and preventative maintenance for such systems. Using simple tools, the operator should be able to maintain the system indefinitely without a costly and time-consuming visit by a skilled technician. Without the correct tools for maintenance, the operator could damage the system or degrade its performance.

BACKGROUND, FEATURES

Workers in the field of document processing, such as in the sorting of bank checks and like financial instruments, know that the art requires the use of specialized machines and systems capable of moving and processing volumes of documents at sustained rates, while performing multiple and inter-related operations upon each document as it travels through the machinery. Such operations include, but are not limited to, printing upon the document (e.g., by hammer print-wheel impact, ink-jet or inked stamp technologies), electronic recognition of previously encoded data, image capture of the document itself, and other processes and manipulations. These individual operations take place in various "stations" in the machine, e.g.: the coder station or the stamp station.

A document processor as here contemplated (e.g., as in FIG. 1) is typically designed to guide documents through the machine by way of pinch rollers through narrow-channeled tracks. It appears that the most consistent feeding of documents is obtained if the track-channel has a very small lateral width relative to its height. The optimum width of the channel (distance between the walls of the track) is a function of the transport speed for the document. With a document processor like the Unisys DP1800, documents travel at a rate of 300 inches per second (ips). This machine has wider channels than that of Unisys DP30 which operates at a track speed of 15 ips. While the optimum track would be perfectly straight without apertures or openings, in reality, the tracks have a number of turns and openings for pinch rollers, sensors and the special operation stations. Such a construction, however, tends to bring about problems of operation and service which are difficult to anticipate. As the volume of documents processed increases, the customer expects and demands that the machinery perform as specified.

Users and designers of these machines know that the documents moving through the system must be accurately spatially located in order for the individual station operations to be correctly carried out. For example, the system must know when a document has reached a station in order for the operation assigned to that station to be initiated. Also, the system must know where each document is to be located at any time so that jams or other misfeeds can be detected. In order for the system to achieve the specified processing rate, the ability of the system to detect the documents during its travel through the machine must be un-hindered.

The Unisys DP30 document processor (e.g., see FIG. 1) uses reflective sensor technology (e.g., see FIG. 3) to detect the presence or absence of a document. A reflective sensor has two parts. One part consists of an infra-red light emitting diode (LED) source, along with a sensor (e.g., a photo diode). Simply put, the LED shines a light and the photo diode detects it. These two parts are formed into a source/sensor assembly (e.g., S in FIG. 3) and are placed parallel to each other at the face of the assembly. Such sensor assemblies are installed at various sites along a machine track, near the bottom of the track. When a document appears in front of the sensor, the light will reflect off of the document and will be detected by the photo diode, hence the name "reflective sensor".

Because the sensor needs to reflect off of a document to detect it, the sensor must be recessed away from the track wall by a small distance, rather than flush with the face of the track. The system is programmed to check to see that the sensor detects the document at the proper time/place. If not, an error is reported, the system shuts down, and operator intervention is then required to correct the problem. Also, if the sensor is reporting incorrect detections of errors, the machine might not detect a true jam and continue to operate and damage the document and the machine.

The location of the reflective sensor behind the track wall, while necessary for proper operation of the sensor, lends itself to a number of problems when used in a document processing environment. As a document passes through the machine, it is exposed to various sources of friction. This friction on the document tends to loosen fibers and other debris from the document and much of this settles to the base of the track. Also, the pinch rollers that move the document through the machine are set at a slight angle to drive the check downward so that it always rides on the base of the track (e.g., see track base T-b, walls ww in FIG. 3). Thus, there is a constant friction between the bottom of the document and the base of the track. This is where all of the paper fiber and other debris settle and this is close to where the reflective sensors are located. Thus, a sensor face will periodically become occluded by debris, etc. and must be cleaned (wiped).

An operator might choose either of two methods to clean the track and sensors of the DP30. One is to direct a blast of compressed air down into the track, the other is to direct a cleaning probe down the track. Such a track-cleaning "wand" might comprise a layer of short, fuzzy fiber at the end of a probe. Neither method can adequately clean the reflective sensors of the DP30. The compressed air method fails to direct a stream of air directly at the face of the sensor due to the sensor's recessed placement behind the track wall. The low pressure area the air creates in front of the recessed sensor can actually attract dust to collect there, rather than be removed. Track cleaning wands fail to reach the face of the sensor because their fibers are not long enough. Also, the wands are typically designed for "look-across" sensors which are flush with the face of the track wall. (Such sensors are found in other Unisys document processors, but in only two locations in the DP30.) Currently, to effectively clean the reflective sensors of the DP30, a field service technician must be called in to sufficiently dismantle the DP30 enough to physically clean the sensors with a cotton swab or rag.

Accordingly, it is an object hereof to teach an instrument which can easily be used by the machine user, be inexpensive and clean the reflective sensors without damage to the machine or extensive "down-time". Also, it would be a further advantage to make the instrument "universal" so that it could reach other reflective sensors (in the DP30 and in other Unisys machines), as well as comparable machines made by other manufacturers, yet reach the unique sensor locations in the DP30.

Thus, it is an object hereof to address the problems, and provide the solution and features mentioned herein. A more particular object is to provide a new cleaning tool for accessing recessed sensors along a document transport track. A related object is to do so in an automatic document processor. Another object is to do so with opposed pairs of cleaning bristles, elongated to so access recessed sensors; e.g., in a track-cleaning wand.

BRIEF DESCRIPTION OF THE DRAWINGS

These and other features of advantage of the present invention will be appreciated by workers as they become better understood by reference to the following detailed descriptions of past and present preferred embodiments which should be considered in conjunction with the accompanying drawings, wherein like reference symbols denote like elements.

FIG. 1 is a schematic upper perspective view of a Unisys DP30 document processor, with a track-cleaning wand embodiment T-w inserted therein, while

The methods and means discussed herein will be generally understood as constructed and operating as presently known in the art, except where otherwise specified; and with all materials, methods, devices and apparatus herein understood as being implemented by known expedients according to present good practice.

DETAILS OF PREFERRED EMBODIMENTS

The figures show how my tool (wand) is to be constructed and used. Only the proper use of the tool as explained will lead to the desired result of effectively cleaning the reflective sensors.

Figure 3:
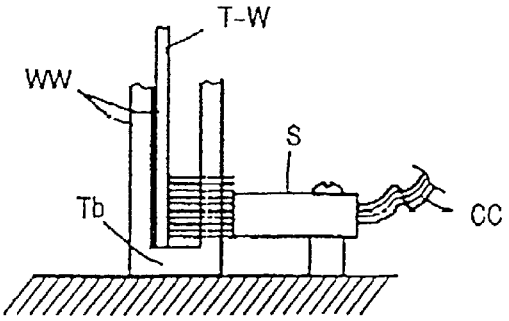
FIG. 3 shows a cross-section of the wand as inserted in the document track of a processor like that in FIG. 1.

FIG. 3 depicts the tool T-w in action, with its brush material understood as contacting the face of a reflective sensor. Note that the reflective sensor is positioned with its face set back (recessed) from the track wall.

Figure 1:
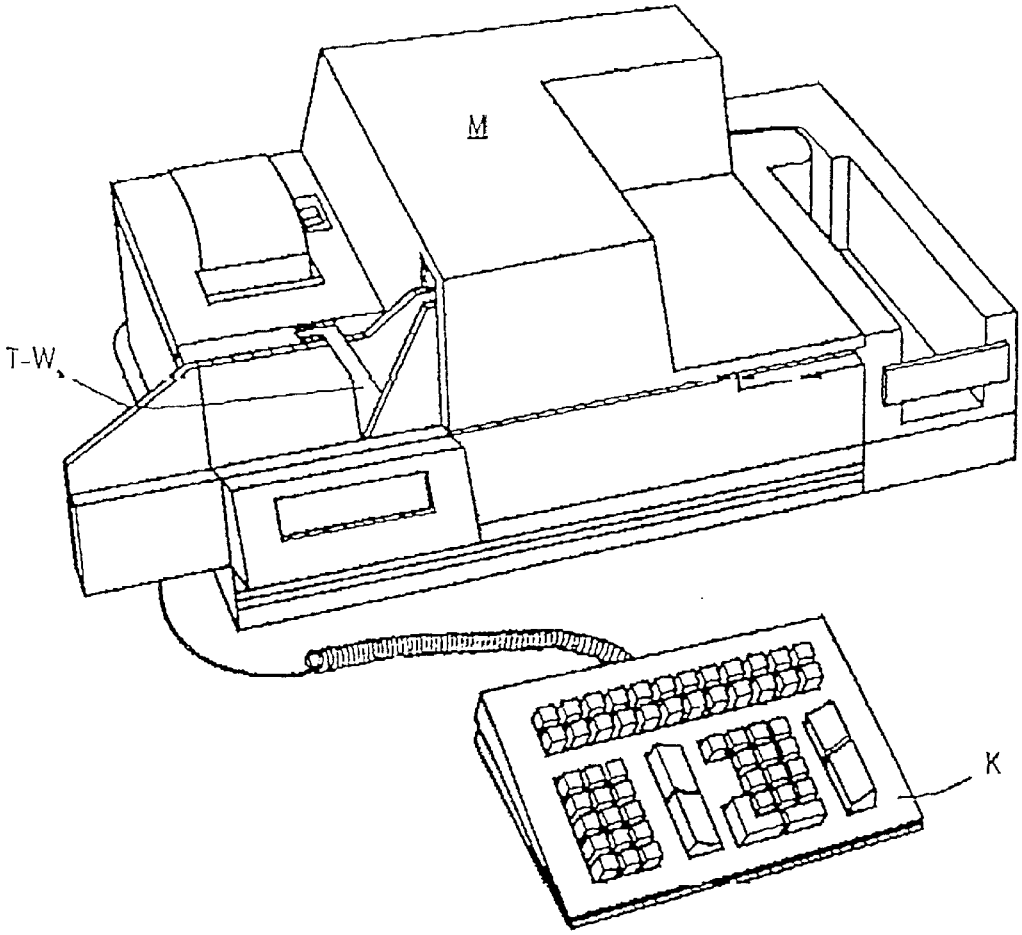

The tool T-w is to be pushed down into the track at the entry area such that the bottom of the tool rests on the track base as shown in FIG. 1. The tool is then slid to the right, into the machine, until it stops. Once here, moving the tool left and right, spanning a distance of about 0.5 inches each time, the brushes remove any collected dust or debris from the first two sensors in the DP30. While the action of the brush physically contacting the sensor face should be enough to clean it, a solution of 50% water and 50% isopropyl alcohol is preferably applied to the bristles first (see brushes E,E' in FIG. 2). The tool can also be inverted so that the single brush at the top of the tool (e.g., see E" in FIG. 2) may be used to clean the other isolated reflective sensors in the DP30, and DP30 modules.

Figure 5A:
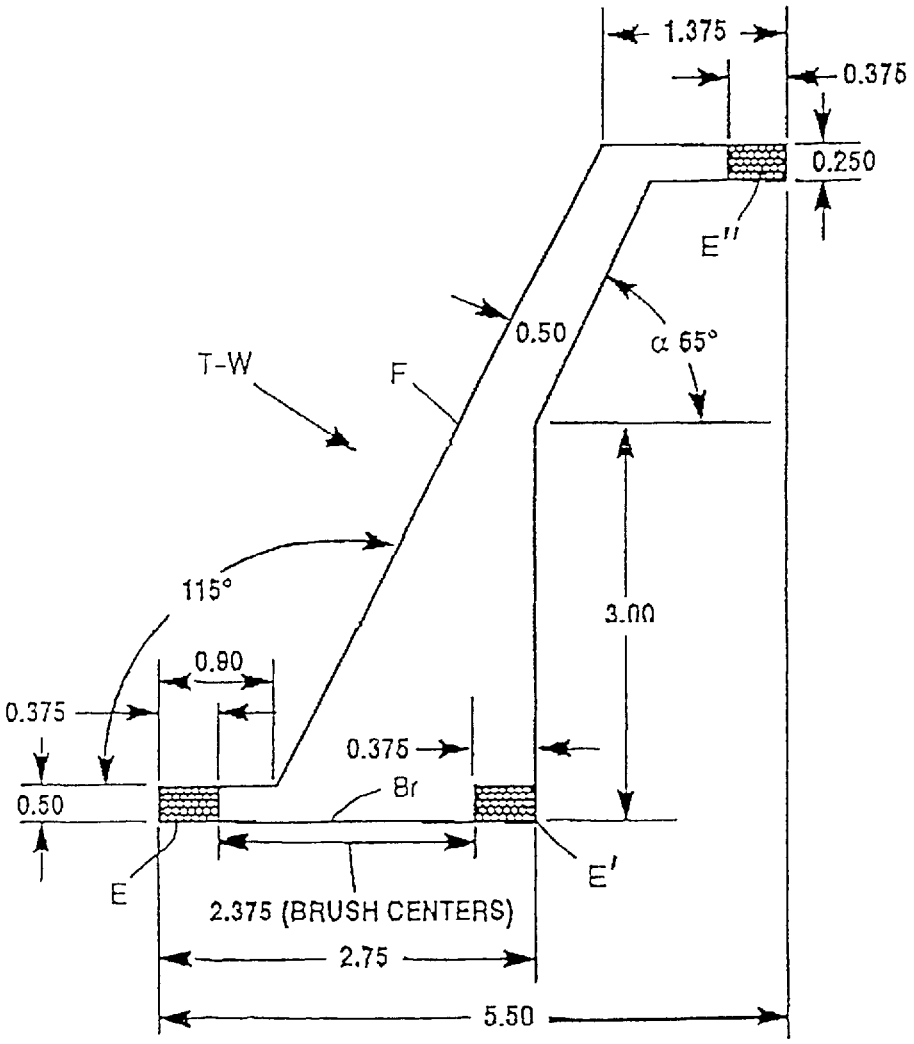
FIG. 5A is an elevation of a modified wand having apposed bristles and FIG. 5B shows this, with the bristle-bar rotated 90°.
Figure 5B:
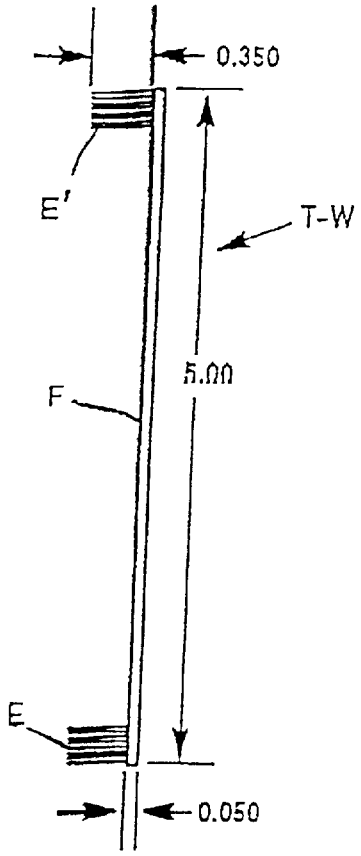

FIGS. 5A, 5B details the dimensional construction of the tool itself. The bottom of the tool (i.e., bar Br, with brushes E,E') is specifically dimensioned to clean the entry and "dog-ear" sensors at the beginning of the track of a DP30. At this location in the DP30, a document gate prevents such common tools as a cotton swab from reaching the "dog-ear" sensor. Considering the bottom of the tool as a foot, the brush E, FIGS. 5A, 5B attached to the extended "toe" is able to slip under the gate and reach this sensor. The "heel" of the tool contains another brush E' that is distanced from the toe brush such that the entry sensor is cleaned at the same time the dog-ear sensor is cleaned. The top of the tool is designed to reach the rest of the reflective sensors in the DP30, as well as any other reflective sensors in other products employing this sensor technology.

The tool is to be constructed of rigid sheet material (e.g., plastic) preferably with a thickness no greater than 0.05 inches. The brush material is to be made with bristles preferably longer than 0.25 inches, including any (fabric) backing. The brush is to be attached to the sheet material (i.e., brush-bar Br on handle F in FIG. 5A).

Figure 4:
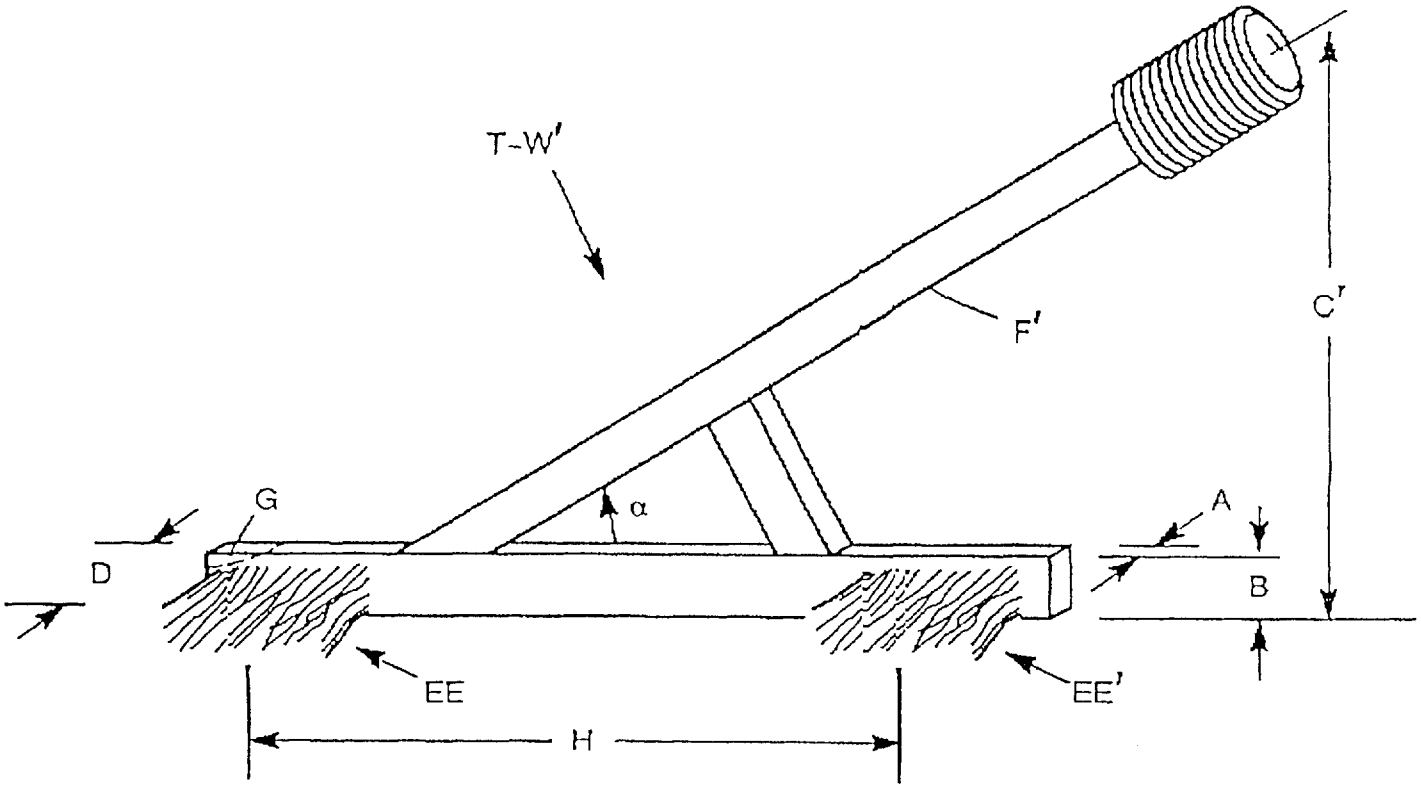
FIG. 4 is an enlarged elevation of a crude version of the wand embodiment.

The wand embodiment T-w' in FIG. 4 is a bit simpler and somewhat modified; it will be understood to comprise a bar Br' on which two bristle units EE,EE° are attached, being spaced apart (H: e.g., on 2.25" centers) preferably to match the spacing of (one or more) contemplated sensor pairs arranged along a document transport track, as known in the art. Preferably, one end G of bar Br' is tapered to allow it to slide under an entry gate in the track (e.g., bar Br' for a DP30 should be wide enough (e.g., 1/16–1/32") so that, with the length of bristles EE,EE' it spans the track plus recess distance D: e.g., here about 1/4" found suitable. It is found suitable for bar height (bristle-height B) to about 3/16–9/32", and bar width A to be about 1/16–3/32".

A handle F' is attached to bar Br' (FIG. 4), preferably at an angle, aa, adapted to accommodate operator use in scrubbing bar Br' and its brushes along the sensor units in a subject track, and to give a height C' to facilitate this (e.g., 5" here, preferably). A grip $F_g$' may be provided at the end of handle F'.

Figure 2:
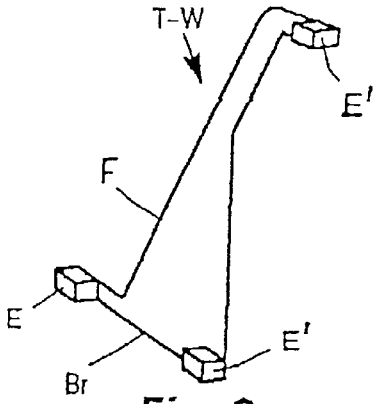
FIG. 2 is a perspective of the wand itself.

Wand T-w in FIGS. 2, 5A and 5B is more preferred. In general it will be understood as constructed and used like wand T-w' in FIG. 4, while being made so the bar Br and handle F are more unitary (integral), and so the top $F_T$ of handle F includes a single brush unit E". The preferred dimensions are given in FIGS. 5A,5B. Workers should understand that single added brush E" added at the top end of handle F is provided, preferably, to enable a user to access sensors that appear to need special treatment (e.g., different cleaning solution, or where access by bar Br is not the best).

This wand T-w may be viewed as an implement or tool for removing dust and debris from the face of reflective sensors in a document processing machine; such implement being preferably constructed of a single piece of rigid material with three brushes attached at strategic locations on the sheet material, the tool being is formed, shaped and constructed to remotely clean the reflective track sensors without disturbing, opening or disassembling the track structure. Further, preferably wand T-w is designed, constructed and adapted to be of sufficiently low cost to be distributed to users of such machinery at minimal cost, to encourage the use of such an implement rather than improvised tools which may damage the document processing machine and to encourage use by the machine user, rather than require the time and skills of a field engineer (e.g., to relieve jams caused by dirty sensors).

CONCLUSION

While such wands are here seen as particularly advantageous for use in automated high-speed check sorting machines, as described, workers will readily understand that they have utility for other, analogous applications, such as high-speed currency handling, printing, document-processing and like machines, which require a sensor-cleaning tool for cleaning recessed sensor units placed along a track.

In conclusion, it will be understood that the preferred embodiment(s) described herein are only exemplary, and that the invention is capable of many modifications and variations in construction, arrangement and use without departing from the spirit of the claims.

The above examples of possible variations of the present invention are merely illustrative and accordingly, the present invention is to be considered as including all possible modifications and variations coming within the scope of the inventions as defined by the claims appended hereto.

What is claimed is:

1. A method of cleaning a document handling machine having a track with side walls along which documents are transported past sensors separated by a first distance and recessed away from the side walls of the track, this method comprising: taking a wand including a rigid handle with, at one end, a rigid elongate spacer bar carrying a pair of brushes spaced apart by said first distance and said brushes having bristles long enough to reach a face of said sensors, when the spacer bar is swept along the track.

2. A method of cleaning a document handling machine having at least one track with side walls along which documents are transported past at least one pair of sensor means, each pair being separated by a first distance and recessed away from the side walls of said track, this method comprising: taking rigid handle means and securing at one end thereof rigid elongate spacer means; disposing a pair of coacting brush means on said spacer means, while spacing said brush means apart by a second separating-distance corresponding to said first distance between said pair of sensor means, and; arranging said brush means to include bristles long enough to reach a face of said at least one pair of sensor means when said spacer means is disposed in said track.

3. The method of claim 2 wherein each of said at least one track includes a base and said brush means are arranged to be swept along said base in cleaning fashion.

4. The method of claim 2, wherein said handle means comprises a thin, strip of rigid material.

5. A method of cleaning a document handling machine having at least one track including a base and side walls along which documents are transported past at least one pair of sensor means, each pair being separated by a distance and recessed away from the side walls of said track, this method comprising: taking rigid handle means having an elongate length and securing, at one end thereof, rigid elongate spacer means disposed oblique to said handle length; disposing a pair of coacting brush means on said spacer means, while spacing said brush means apart by a separation-distance corresponding to the separated distance of said pair of sensor means, arranging each brush means to include bristles long enough to reach a face of said sensor means when said spacer means is disposed in said track; and using said handle means to sweep along said base in cleaning fashion.

6. The method of claim 5, wherein said spacer means is made to comprise a rigid bar made integral with said handle means, and said brush means is arranged to sweep along said base when inserted along said track.

7. The method of claim 6, wherein said handle means is constructed from a strip of thin rigid material.

8. The method of claim 7, wherein a further separate brush means is mounted at a proximate end of said handle means.

* * * * *